US006323815B1

(12) United States Patent
Rao et al.

(10) Patent No.: US 6,323,815 B1
(45) **Date of Patent: *Nov. 27, 2001**

(54) ANTENNA CONFIGURATION FOR LOW AND MEDIUM EARTH ORBIT SATELLITES

(75) Inventors: Sudhakar K. Rao, Torrance; Philip H. Law, Encino, both of CA (US)

(73) Assignee: Hughes Electronics Corporation, El Segundo, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/590,325

(22) Filed: Jun. 8, 2000

Related U.S. Application Data

(63) Continuation of application No. 09/196,864, filed on Nov. 20, 1998.

(51) Int. Cl.[7] ..... H01Q 19/06
(52) U.S. Cl. ..... 343/753; 343/911 R
(58) Field of Search ..... 343/753, 762, 343/909, 910, 911 R, 911 L; H01Q 19/06

(56) References Cited

U.S. PATENT DOCUMENTS 3,835,469 * 9/1974 Chen et al. ..... 343/754
5,821,908 * 10/1998 Screenivas ..... 343/911 R

* cited by examiner

*Primary Examiner*—Hoanganh Le
(74) *Attorney, Agent, or Firm*—Terje Gumestad

(57) ABSTRACT

An antenna configuration suitable for LEO/MEO satellites includes a plurality of lenses whereby each lens has a plurality of feed horns positioned with respect to the lens. The lens has a first surface and a second surface. The plurality of feed horns is disposed upon a curved surface. Each of the plurality of feed horns generates a beam that has a phase distribution. The phase distributions have a predetermined phase relationship with the first surface and preferably the second surface. This allows the lens to transmit and receive a signal with desired phase distribution across a cross-section of the beam. The beams from the plurality of lenses are inter-leaved on the ground to form a contiguous coverage with multiple overlapping spot-beams.

4 Claims, 11 Drawing Sheets

FIG. 9
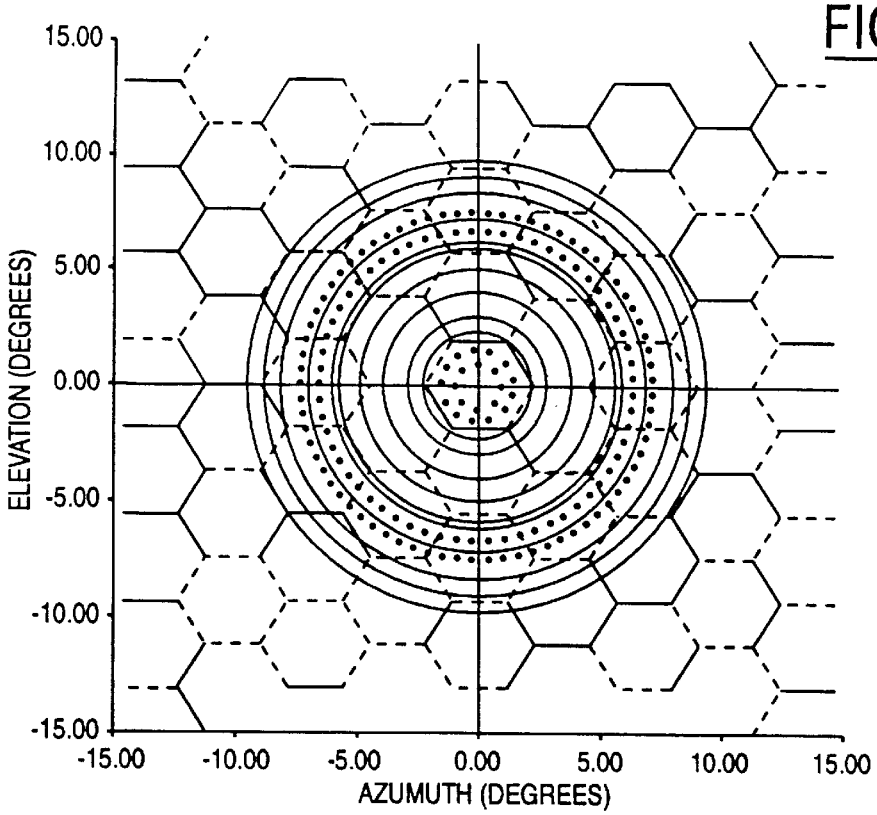
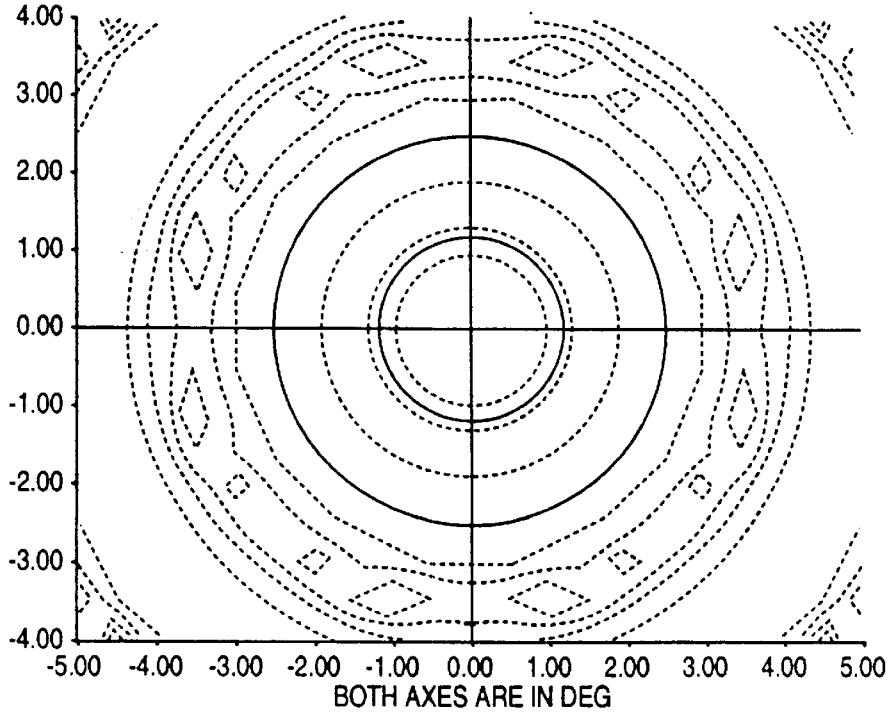
FIG. 10

FIG. 11
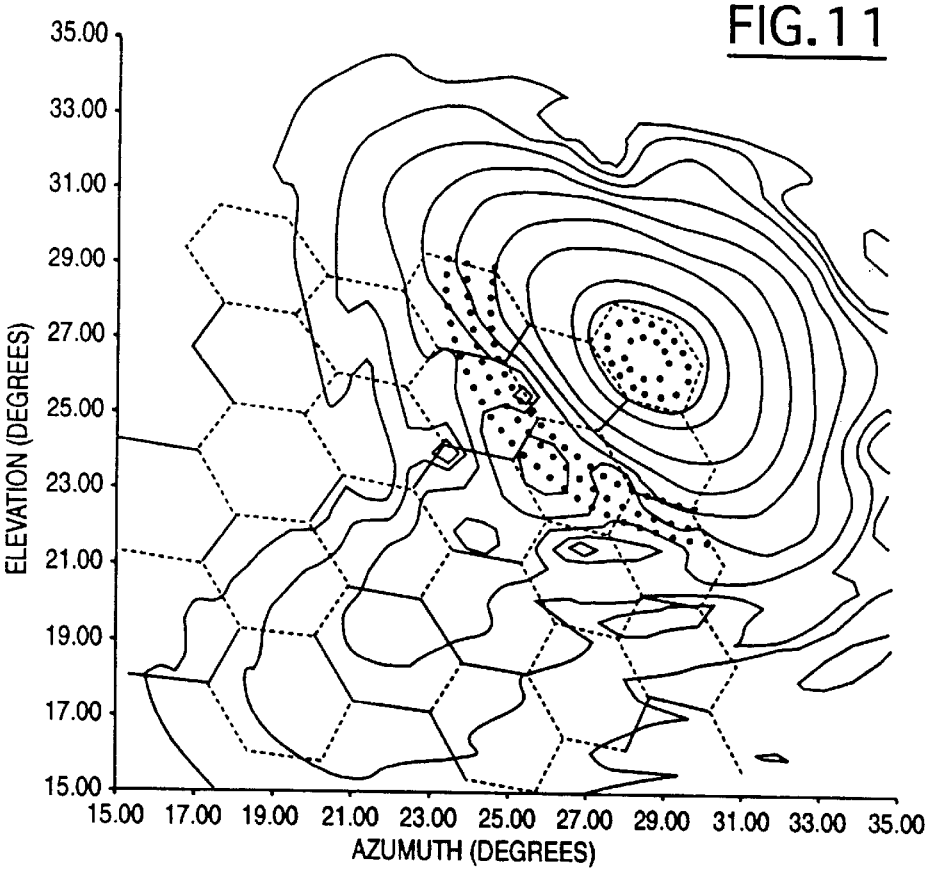
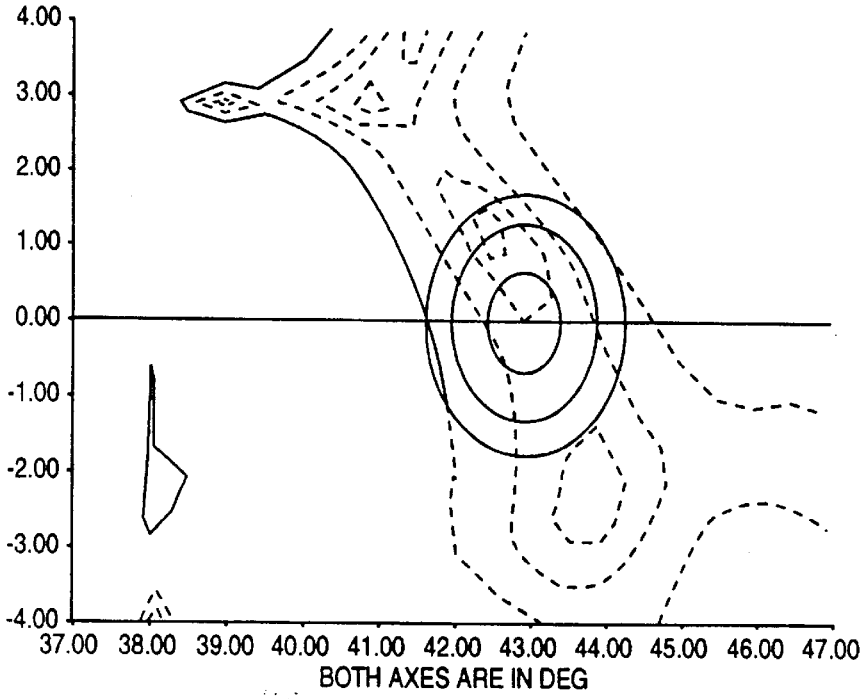
FIG. 12

ANTENNA CONFIGURATION FOR LOW AND MEDIUM EARTH ORBIT SATELLITES

This application is a continuation of Ser. No. 09/196,864 filed Nov. 20, 1998.

TECHNICAL FIELD

The present invention relates to space and communications satellites, and more particularly, to an antenna configuration for a multiple beam satellite, suitable foe being operated in low or medium earth orbits (LEO/MEO).

BACKGROUND ART

Satellites in geostationary orbits (GSO's) have been widely preferred because of the economic advantages afforded by such orbits. In a geostationary orbit, a satellite traveling above the earth's equator, in the same direction as that in which the earth is rotating, and at the same angular velocity, appears stationary relative to a point on the earth. These satellites are always "in view" at all locations within their service areas, so their utilization efficiency is effectively 100 percent. Antennas on earth need be aimed at a GSO satellite only once; no tracking system is required.

Given the desirability of geostationary satellite orbits and the fact that there are only a finite number of available "slots" in the geostationary "belt," the latter capacity has been essentially saturated with satellites operating in desirable frequency bands up through the Ku-band (up to 18 GHz). As a result, the government has been auctioning the increasingly scarce remaining slots.

This has encouraged the development of complex and expensive new systems including those using low earth orbits (LEO's), medium earth orbits (MEO's), and higher frequencies, for example, the Ka and V-bands (up to approximately 50 GHz). Growth to higher frequencies is limited by difficult problems of technology and propagation, and expansion in satellite applications requires exploitation of the spatial dimension (i.e., above and below the GSO belt). A host of proposed LEO and MEO systems exemplify this direction.

For LEO satellites, however, larger beams are required at the center of coverage and smaller beams near the edges of the coverage to compensate for the path length differences. In addition, the beams are required to be circular close to the center of coverage and elliptical at the edge of coverage for a uniform cell size on the earth. The different beam requirements increase the complexity of the beam-forming circuitry.

In known satellite systems, signals from each feed are divided into a number of beam portions. Each portion is amplitude and phase weighted using variable active components. The beam portions are then combined to form beams. The feed network for the known systems becomes quite complicated because a large dividing network, a large combining network and large number of variable attenuators and/or variable phase shifters are required. The number of variable attenuators is the product of the number of beams and the number of elements per beam.

Weight, size and power consumption are always a concern with satellite designs. The beam-forming network is complex and thus the weight and size and power consumption are relatively high. It would therefore be desirable to reduce the complexity of the beam-forming network and therefore reduce the size, weight and power consumption of the satellite.

SUMMARY OF THE INVENTION

The present invention is an antenna for a satellite that may use only one feed per beam. It does not require a beam former to generate various size beams. The satellite antenna configuration includes a dielectric lens and a plurality of feed horns positioned appropriately with respect to the lens. The lens has a first surface and a second surface. The lens is common to all beams and is shaped such that it converts an incident spherical wavefront from the feeds to a planar wave front at the exit aperture of the lens. The plurality of feed horns are disposed upon a curved surface. Each of the plurality of feed horns generates a primary beam on the inner surface of the lens, which is phase-corrected by the lens surfaces and creates a secondary beam from the lens outer surface onto the earth. The amplitude and phase distributions at the outer surface of the lens control the secondary beam size and shape. The desired amplitude and phase distributions are achieved by controlling the feed size, its location relative to the lens, and the shape of the lens.

One advantage of the invention is that the use of active components for amplitude and phase weightings is eliminated. Also, the number of uplink and downlink amplifiers is reduced.

Another advantage is that the present invention may also be applied to GEO satellites.

Other advantages and features of the present invention will become apparent when viewed in light of the detailed description of the preferred embodiment when taken in conjunction with the attached drawings and appended claims.

BRIEF DESCRIPTION OF THE DRAWINGS

FIG. 9 is a plot of the central beam copolar patterns.

FIG. 10 is a plot of cross-polar patterns of the central beam of FIG. 8.

FIG. 11 is a plot of an edge beam copolar patterns.

FIG. 12 is a plot of the cross-polar patterns of the edge beam of FIG. 10.

BEST MODE(S) FOR CARRYING OUT THE INVENTION

Figure 1:
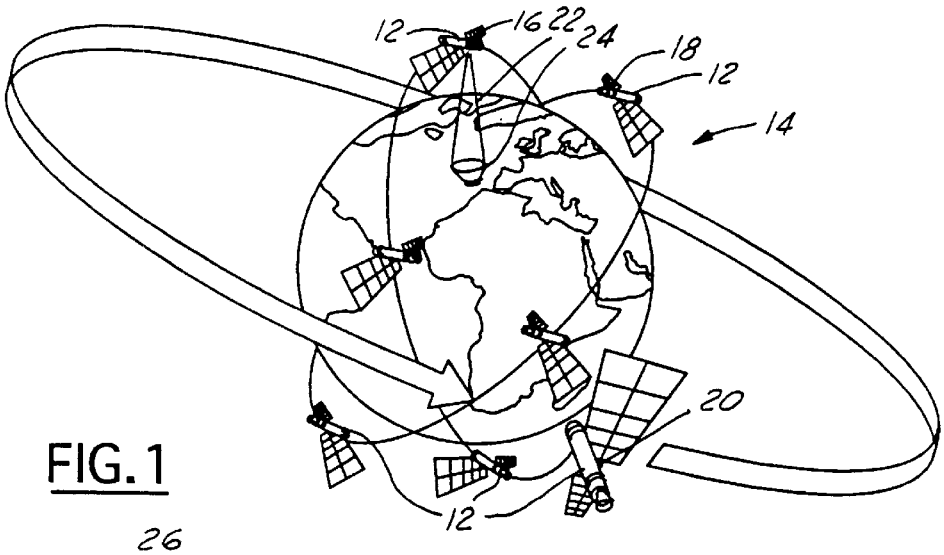
FIG. 1 is a view of a satellite in the deployed configuration in which the present invention is applicable.

Referring now to FIG. 1, the present invention is intended for use with satellites 12 that form a communication network 14. Network 14 may be formed of low earth orbit (LEO) satellites 16, medium earth orbit (MFO) 18 satellites, a CGEO stationary orbit (CSO) satellite or any combination thereof. Each satellite 12 projects a plurality of beams, one of which is shown at 22, to the surface of the earth. Beams 22 may be used to transmit and receive communications from the earth's surface. Beam 22 projects a footprint 24 onto the surface of the earth.

Figure 2:
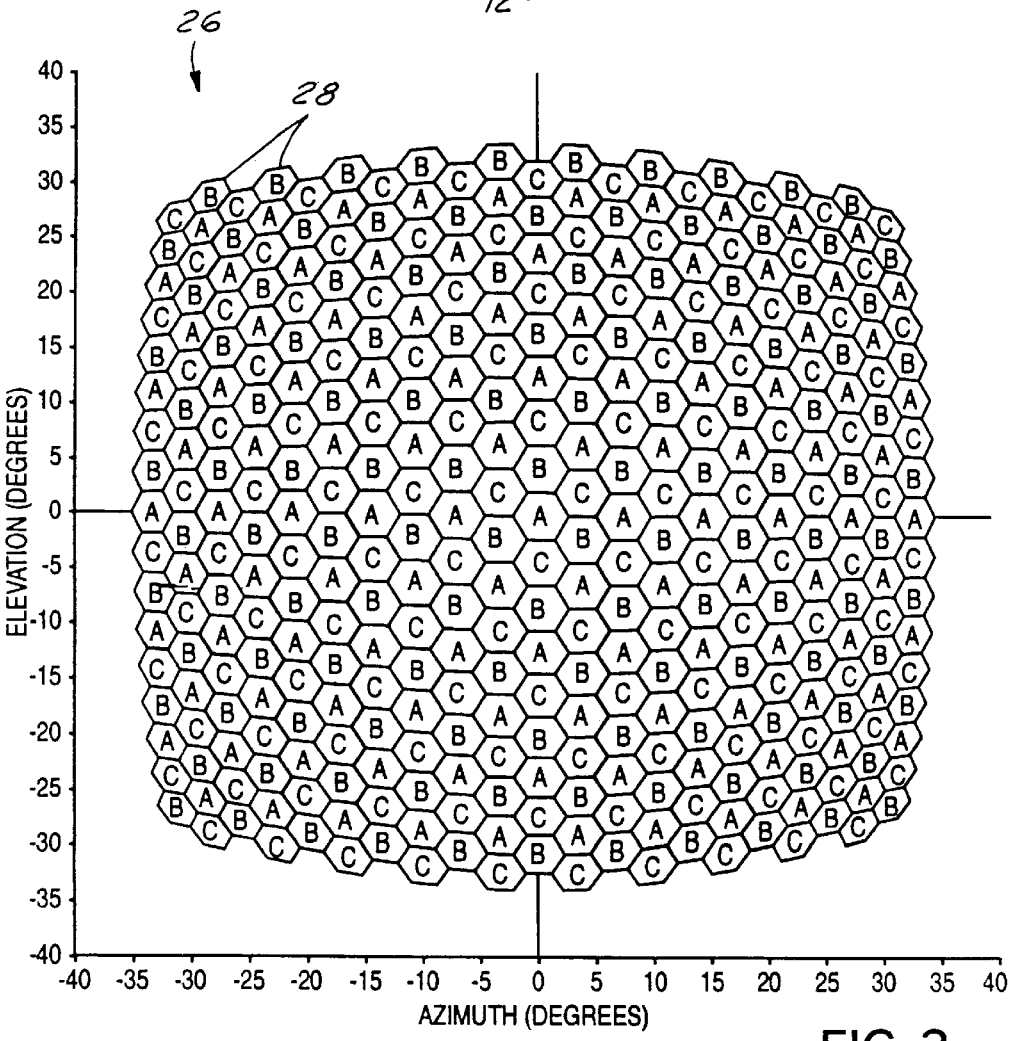
FIG. 2 is a plot of a beam layout formed with an antenna configuration according to the present invention.

Referring now to FIG. 2, a beam layout 26 for a medium earth orbit or low earth orbit satellite of the present invention is shown. A plurality of footprints 28 are labeled A, B, and C. Each of the three footprints comes from three different lens apertures that are formed according to the present invention. As will be further described below, the footprints labeled A, the footprints labeled B, and the footprints labeled C originate from a respective antenna aperture.

Figure 3:
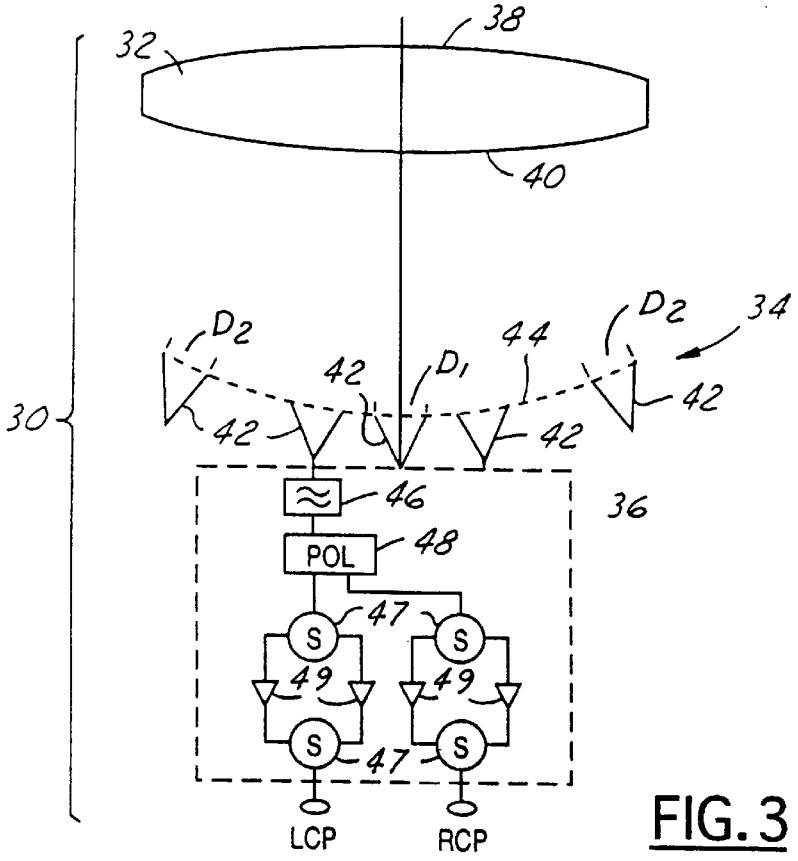
FIG. 3 is an antenna configuration for forming beams according to the present invention.

Referring now to FIG. 3, an antenna 30 is illustrated for generating a plurality of beams. In practice, a number of antennas 30 may be used to generate the beams. In FIG. 2 above, three antennas 30 were used to generate the plurality of beams. Each beam labeled A, P, and C originates from a respective antenna.

Antenna 30 has a lens 32, a plurality of antenna elements 34, and a feed network 36 coupled to antenna elements 34.

Lens 32 reshapes a beam of electromagnetic energy signals that is directed therethrough. Lens 32 preferably has an outer surface 38 that is spherical and an inner surface 40, which is also curved. Inner surface 40 has a curve shape so that an incident spherical wavefront distribution from antenna elements 34 is converted to a planar wavefront distribution at the output aperture of the lens. This allows the lens to transmit and receive a signal with a uniform phase distribution across a cross-section perpendicular to the longitudinal axis of the beam.

Preferably, outer surface 38 of lens 32 is spherical and the inner surface 40 is shaped. The inner surface of the lens may also be zoned to reduce the mass and minimize the coma errors for the scanned beams. Lens 32 satisfies the so-called Abbe-Sine condition for scanned beams. Both the inner and outer surfaces of the lens may be surface matched using circumferential slots to match the lens to free-space and to reduce the mass.

Antenna elements 34 are an array of feed horns 42 disposed about a curved surface 44. As will be further described below, curved surface 44 has a geometric relationship to lens 32. Feed horns 42 illustrated are arrayed in the azimuth and elevation planes.

Feed network 36 is coupled to each of the feed horns 42 and has a typical configuration for each antenna element 34. Each feed horn 42 has a filter 46 used to reject either transmit or receive frequencies. Filter 46 is coupled to a polarizer 48. Polarizer 48 is used to generate different polarizations. For example, polarizer 48 may generate dual circular polarizations (left-hand and right-hand circular). Polarizer 48 has two inputs consisting of two switches 47 and a redundant low noise amplifier 49. Thus, half of the total number of beams from each respective antenna 30 is oppositely polarized. Using two different polarizations increases the spectral reuse by two-fold.

Feed horns 42 preferably have varying diameters. The central feed horn has a diameter da larger than the edge feed horn. The diameters of the feed horns decrease moving from the center feed horn to the edge feed horn, which has a diameter $d_2$. This allows the center beam to have a larger diameter.

Figure 4:
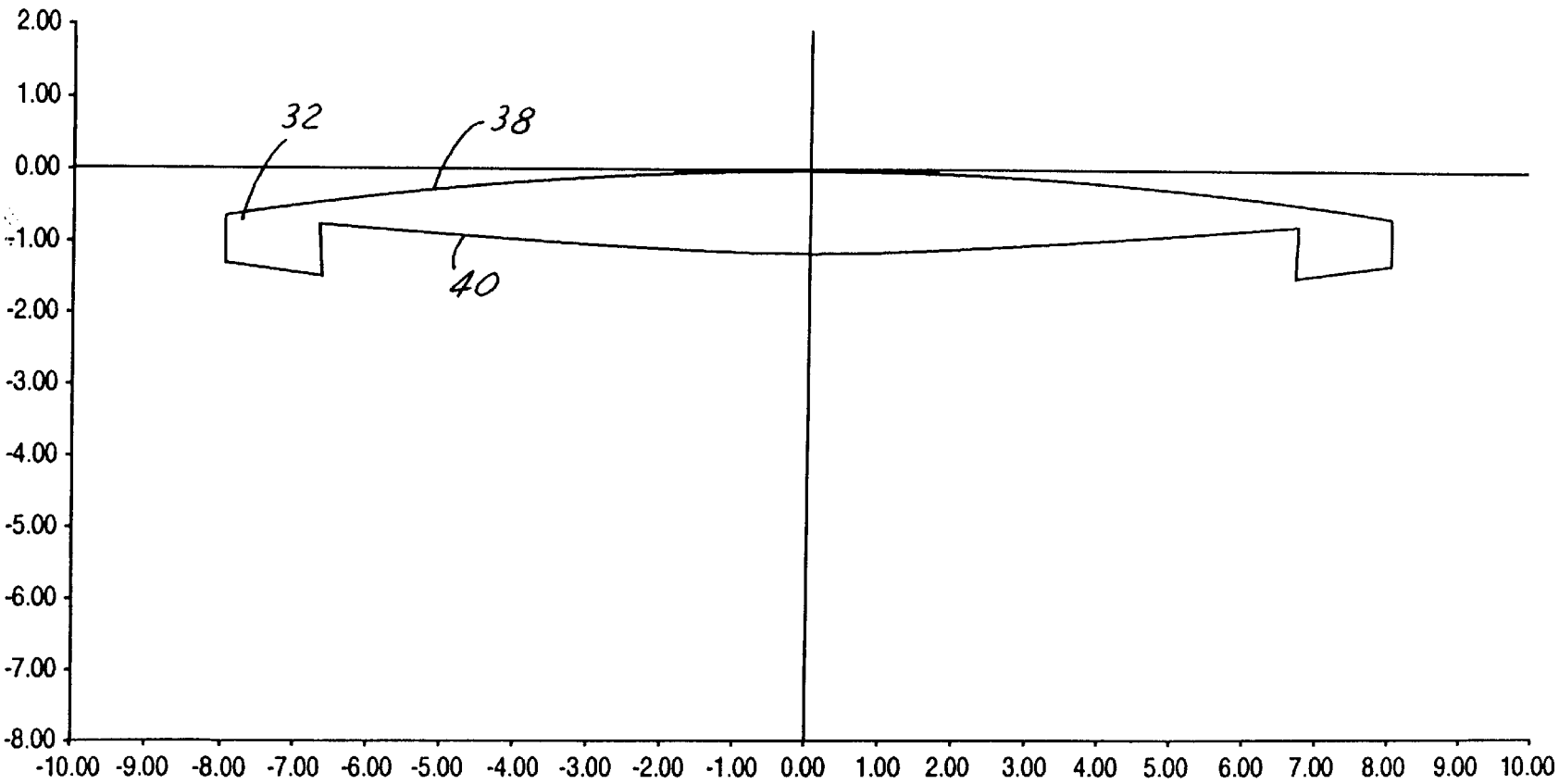
FIG. 4 is a cross-sectional view of a lens according to the present invention.
Figure 5:
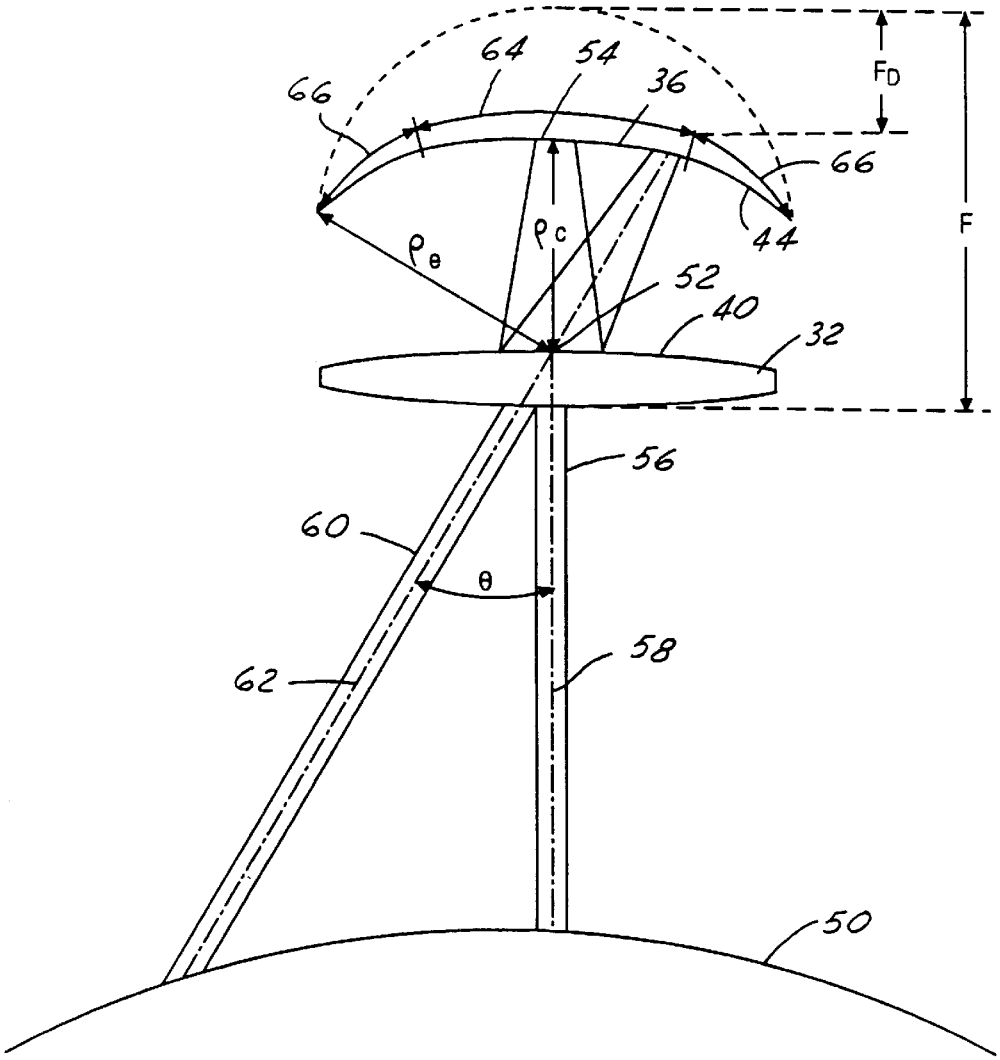
FIG. 5 is a schematic diagram of a lens and feed array positioned above the earth's surface.

Referring now to FIG. 4, a cross-section of a suitable lens geometry having a focal length to diameter ratio (F/D) of 3.0 is illustrated. In this example, lens 32 has a diameter of 16 inches and a focal length of 48 inches. The relatively large F/D ratio minimizes the scan losses and reduces the cross-polar radiation from the lens. The inner surface 40 of lens 32 has a shape to have an even phase distribution across the outer surface 38 of lens 32.

Referring now to FIG. 1, a feed network 36 is illustrated with respect to lens 32 and the earth's surface 50. Lens 32 has a central point 52 located in the center of inner surface 40. A center feed 54 generates a central beam 56 that has a center line 58. Center feed 54 is located a distance $\rho_c$ distance away from inner surface 40 of lens 32. Central beam 56 is directed from the central point 52. Central beam 56 is focused by lens 32 to a displaced focal point instead of the real focus F. The distance between curved surface 44 and lens 32 is the distance $F-F_D$. The distance by which the central beam feed is defocused is $F_D$. The mathematical relationship between the distance of center feed 54, the focal length F and angle 0 is:

$$\rho_c=(F-F_D)\ (1+\cos\theta)/2$$

This formula is applicable to feeds along curve surface 44. By forming the beam with the distances calculated by the formula above, the desired quadratic phase distribution of the beams across the lens surface is achieved to broaden the beams. The beam may also have a linear phase relationship with the outer surface 38 so that the beam is directed to appropriate locations on the earth.

As the distance from center feed 54 increases, the distance $\rho_c$ changes. The outermost feed location is defined by the equation:

$$\rho_e=F\cos^{n/\theta}$$

The ellipticity of the beams can be varied by changing the "n" value. Elliptical beams with either minor axis parallel to the scan plane or perpendicular to the scan plane can also be produced by varying the "n" value. As shown, curved surface 44 has generally two different curves. The first curve 64 is located in the central portion of curved surface 44. First curve 64 has a generally spherical cross section. The curved surface 44 also has a second curved area 66 around the outer edge of curved surface 44 with feed locations defined by $\rho_e$.

It is important to note that the desired phase distribution for each of the beams has two components: a linear phase distribution across the outer aperture plane of the lens to direct the beam to required location on the earth; and a quadratic phase distribution across the outer aperture plane of the lens to broaden the central beams.

In practice, because there are so many variables associated with forming a beam, the desired footprint of the beam on the earth's surface 50 is determined. This allows the focal length and the defocusing distance to be determined. The angle ρ may also be determined as a function of the distance from the center feed. Thus, the varying $\rho_c$ may be determined for each feed. A typical value for "n" is 2.2. Curved surface 44 may be determined by curve fitting a smooth curve between the central beam and an edge beam. The end values for the edge beams may be in the range of 1.8 to 2.2 in order to produce elliptical beams with minor axis of the ellipse rotated along the scan plane. Each of the beams preferably is directed toward the central point 52 of the inner surface 40 of lens 32.

In practice, the diameter of the central beam is preferably about 56–60% larger than an edge beam. This geometry corresponds to the curvature of the earth wherein the edge beams are smaller due to the greater distance traveled.

Figure 6:
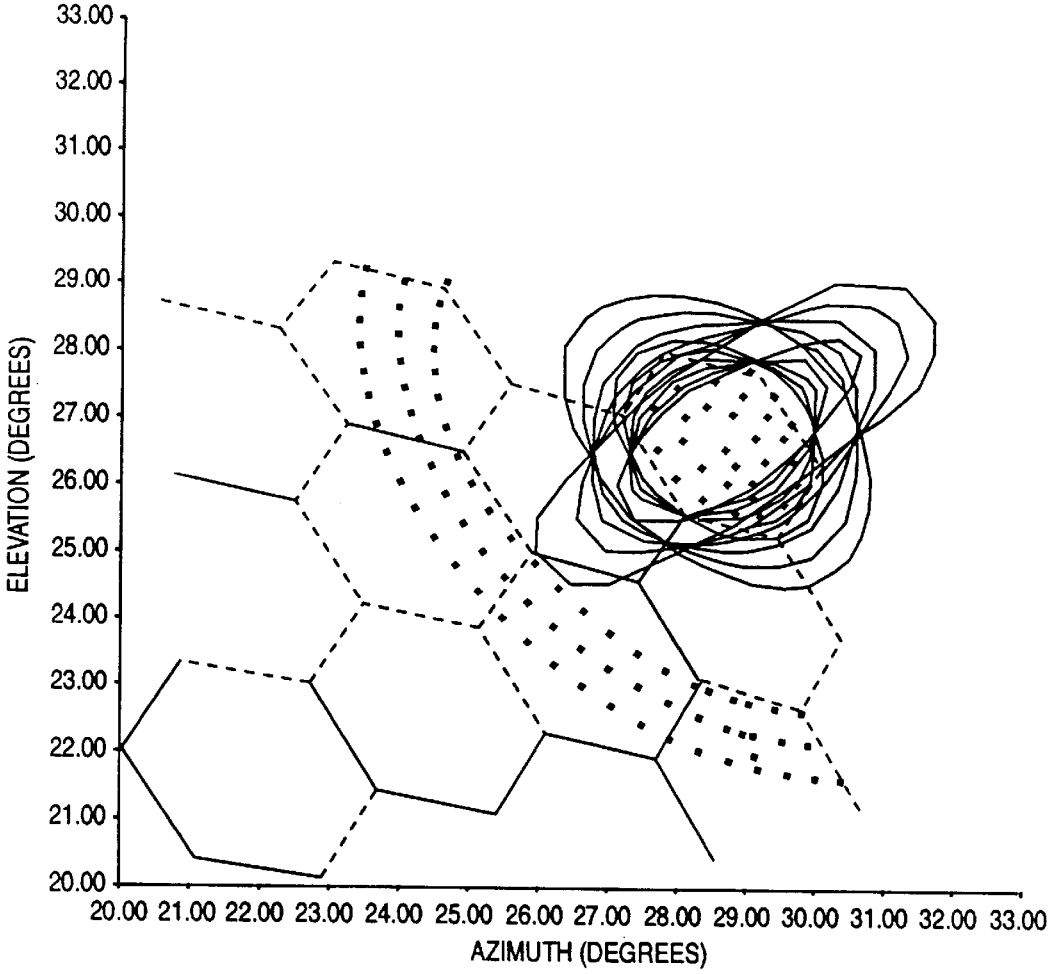
FIG. 6 shows generations of various beams having different ellipticity value.

Referring now to FIG. 6, a beam contour plot shows the variation of beam ellipticity and beam rotation by varying the "n" value. The plot shows the beam pattern footprint with respect to azimuth degrees and elevation degrees.

Figure 7:
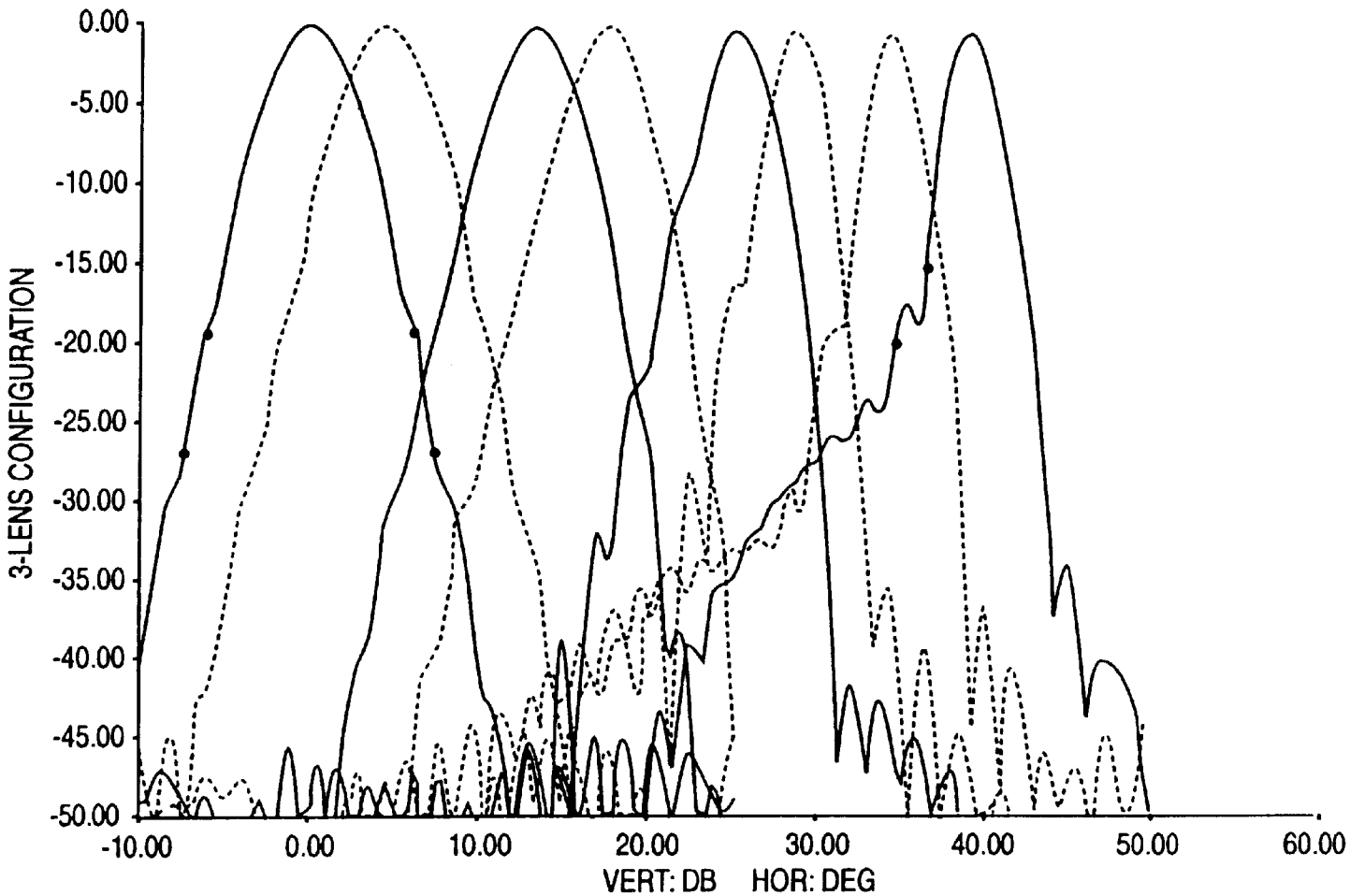
FIG. 7 is a plot of computed copolar beam patterns according to the present invention.

Referring now to FIG. 7, a plot of computed beam patterns of a low earth orbit satellite is illustrated. The beam patterns illustrated are taken along the azimuth. The computed patterns use a very accurate ray tube analysis. The beams overlap and become elliptical near the edge of the coverage.

Figure 8:
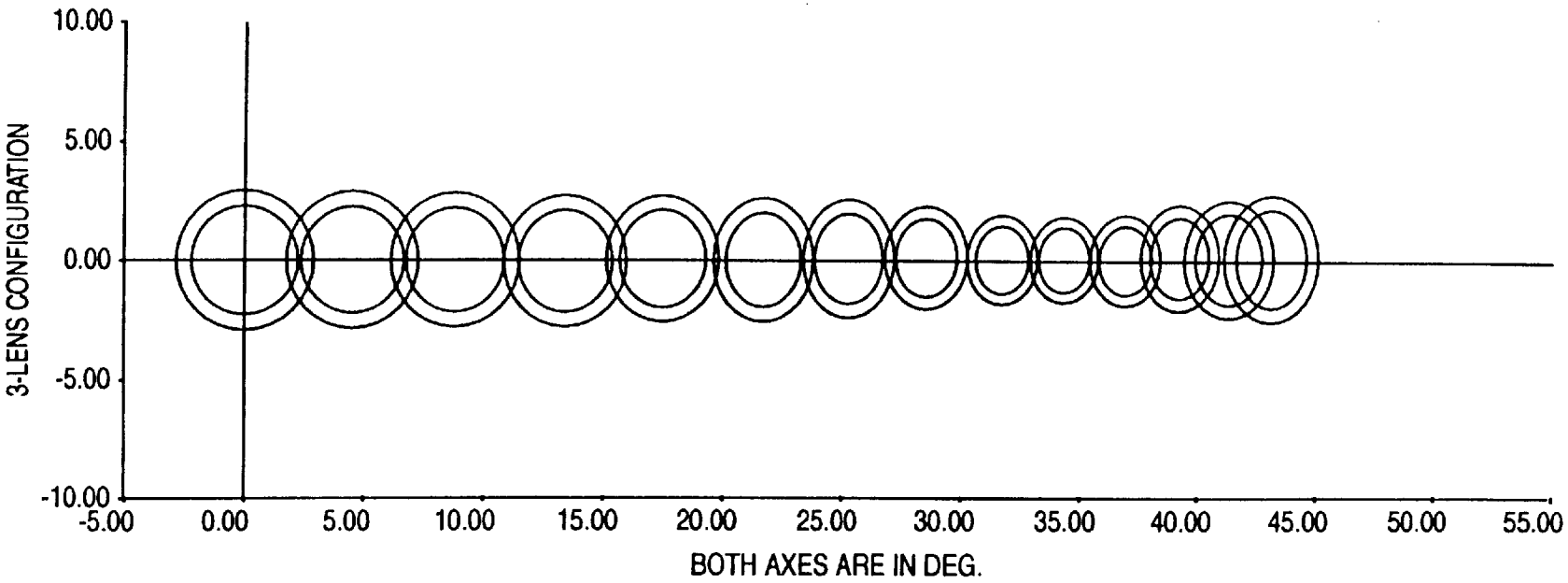
FIG. 8 is a layout of beam patterns plotted according to the present invention.

FIG. 8 is a plot of computed beam contour versus axes degrees for the azimuth beams of FIG. 7.

Referring now to FIGS. 9 and 10, plots of a central beam copolar and cross-polar patterns are illustrated. The plots are in azimuth degrees versus elevation degrees.

Referring now to FIGS. 11 and 12, plots of an edge beam copolar and cross-polar patterns are illustrated in azimuth degrees versus elevation degrees.

Figure 13:
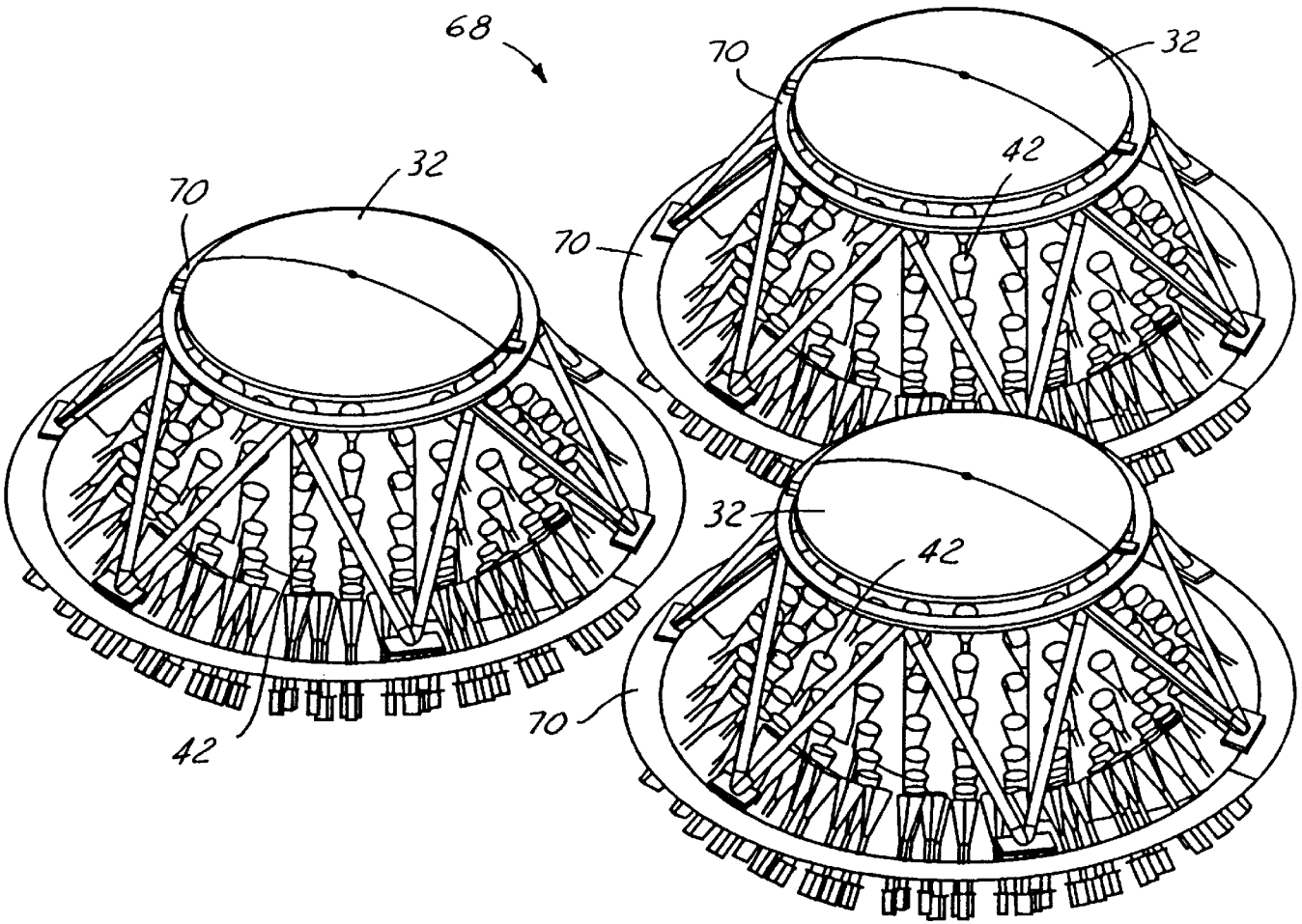
FIG. 13 is a prospective view of an antenna configuration having three lenses according to the present invention.

Referring now to FIG. 13, a layout of an antenna configuration 68 using three lenses 32 is illustrated in perspective. The plurality of feed horns 42 are shown positioned with respect to lens 32. A housing 70 is used to position lens 32 with respect to feed horns 42. The generated beams from antenna configuration 48 form a beam pattern as shown in FIG. 2. Each lens 32 may have the same diameter.

Figure 14:
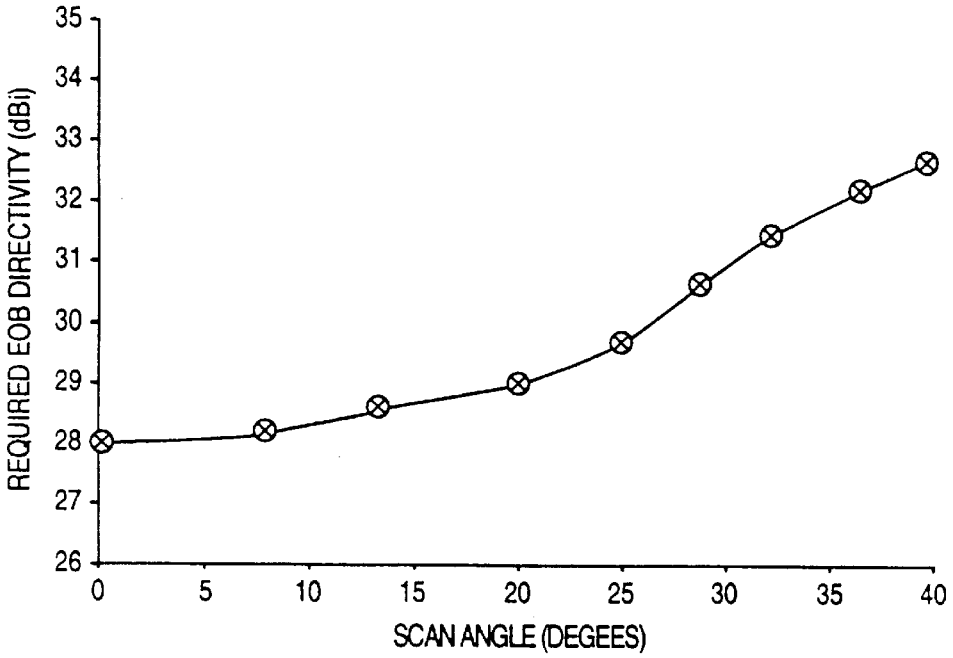
FIG. 14 is a computed edge of directivity value plots for different beams of a LEO satellite.

Referring now to FIG. 14, a plot of scan angle versus required directivity is illustrated for the antenna configuration of FIG. 13. The edge of directivity coverage is about 4.7 dB higher than the central beam C directivity that compensates for the increased space attenuation for the edge beams.

Figure 15:
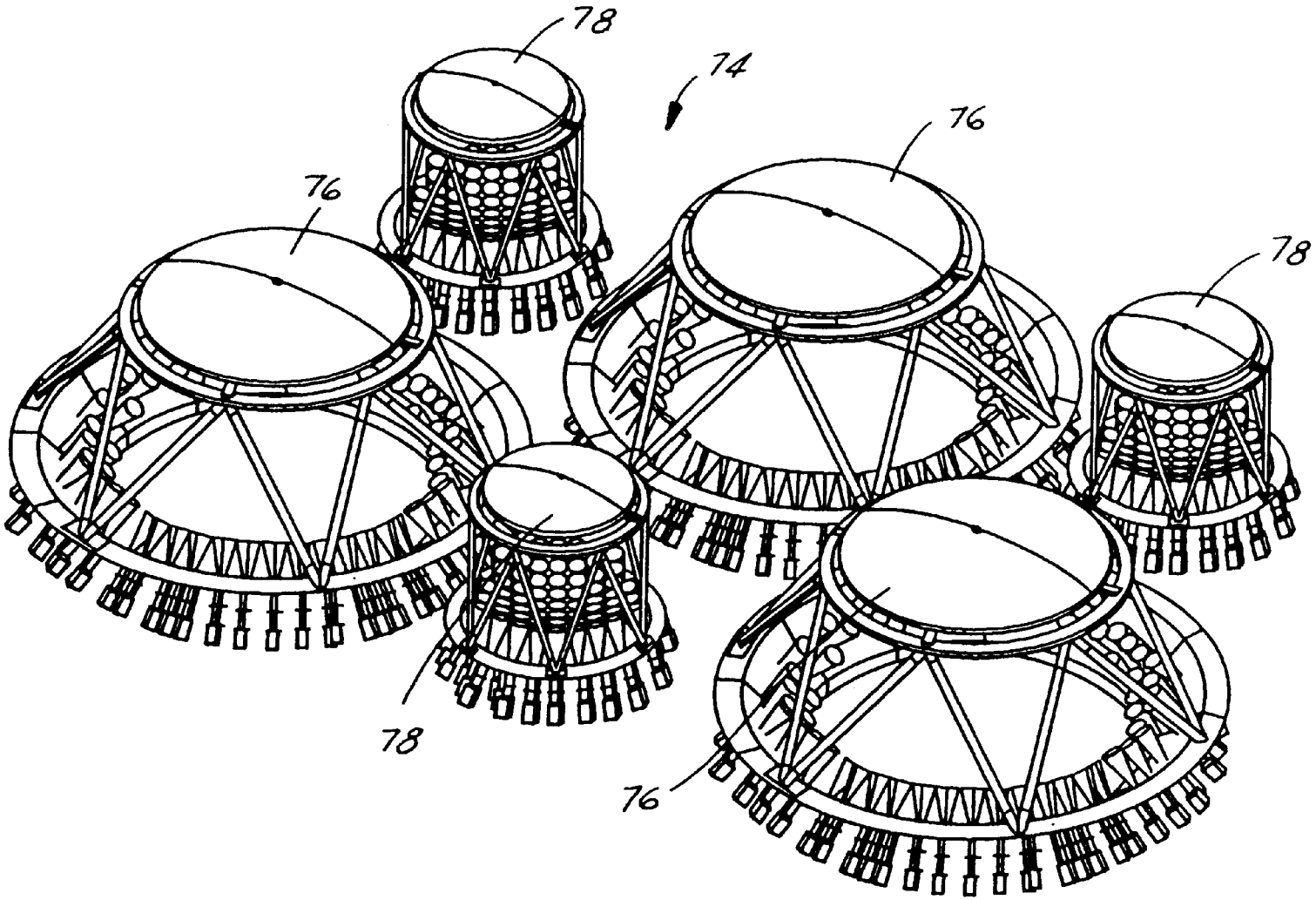
FIG. 15 is an alternative antenna configuration having two different size lenses.

Referring now to FIG. 15, a variation of antenna configuration 68 of FIG. 13 is shown as antenna configuration 74. In this configuration, a plurality of lenses 76 having an equal diameter are shown. Lenses 78 are smaller in diameter than lenses 76 in FIG. 15. This configuration jives maximum flexibility for interleaving various size beams in forming the beam pattern.

The present invention may also be used for geostationary satellites with the exception that no defocusing for the feed array is required. Also, the focal surface becomes almost spherical with each feed looking at the center of the lens. The lens is capable of scanning ±20 beam widths from the boresight with minimal scan loss.

As is described above, the invention greatly simplifies the feed array geometry by eliminating the beam-forming network. Also eliminated is the use of active components used inside the beam-forming network. This significantly reduces the weight and complexity of the satellite.

While particular embodiments of the invention have been shown and described, numerous variations and alternate embodiments will occur to those skilled in the art. Accordingly, it is intended that the invention be limited only in terms of the appended claims.

What is claimed is:

1. An antenna configuration comprising:

a lens having an first surface and a second surface, said second surface having a spherical shape; and a plurality of feed horns having a plurality of diameters, said plurality of feed horns disposed upon a curved surface, each of said plurality of feed horns generating a beam having an amplitude and phase distribution, said distribution having a predetermined phase relationship with said lens surface, wherein said plurality of feed horns have a center feed horn having a first diameter and an edge feed horn having, a second diameter, said center feed horn has a first diameter greater than said second diameter.

2. An antenna configuration as recited in claim 1 wherein said first diameter is greater than the second diameter by about between 56 percent and about 60 percent.

3. An antenna configuration comprising:

a lens having an first surface and a second surface wherein said second surface has a spherical shape; and a plurality of feed horns having a plurality of diameters, said plurality of feed horns disposed upon a curved surface, each of said plurality of feed horns generating a beam having an amplitude and phase distribution, said distribution having a predetermined phase relationship with said lens surface, wherein a distance between a center of said second surface and a feed array is defined by:

$$(F-F_D)(1+\cos\theta)/2$$

wherein F is a focal length of said second surface, $F_D$ is a defocusing distance, $\theta$ is the angular distance between a central focal line and a beam.

4. An antenna configuration comprising:

a lens having an first surface and a second surface wherein said second surface has a spherical shape; and a plurality of feed horns having a plurality of diameters, said plurality of feed horns disposed upon a curved surface, each of said plurality of feed horns generating, a beam having an amplitude and phase distribution, said distribution having a predetermined phase relationship with said lens surface, wherein the edge beam feeds are located on a surface defined by:

$$\rho_{el-F\ cos}{}^{n}\theta$$

wherein the exponent n controls the beam ellipticity values;

F is a focal length of said second surface; and $\theta$ is the angular distance between a central focal line and a beam.

* * * * *

UNITED STATES PATENT AND TRADEMARK OFFICE

CERTIFICATE OF CORRECTION

PATENT NO. : 6,323,815 B1 
DATED : November 27, 2001
INVENTOR(S) : Sudhakar K. Rao and Philip H. Law It is certified that error appears in the above-identified patent and that said Letters Patent is hereby corrected as shown below:

Column 4,
Line 34, should read as follows:
-- $\rho_e = F \cos^{n/\theta}$ --

Column 6,
Line 48, should read as follows:
-- $\rho_e = F \cos^{n/\theta}$ --

Signed and Sealed this

Tenth Day of December, 2002

JAMES E. ROGAN
*Director of the United States Patent and Trademark Office*